United States Patent [19]

O'Connor

[11] Patent Number: 4,478,730

[45] Date of Patent: Oct. 23, 1984

[54] BOWLING LANE OIL COMPOSITION

[75] Inventor: Robert J. O'Connor, Palo Alto, Calif.

[73] Assignee: Cedric P. Spellman, Pleasanton, Calif.

[21] Appl. No.: 481,367

[22] Filed: Apr. 1, 1983

[51] Int. Cl.[3] ..... C10M 1/32

[52] U.S. Cl. ..... 252/34.7; 252/34; 252/50; 252/51

[58] Field of Search ..... 252/34.7, 34, 50, 51

[56] References Cited

U.S. PATENT DOCUMENTS 2,321,517 6/1943 Rosen ..... 252/51

3,634,243 1/1972 Wessels ..... 252/34.7

4,248,719 2/1981 Chafetz et al. ..... 252/34

*Primary Examiner*—Jacqueline V. Howard

*Attorney, Agent, or Firm*—Manfred M. Warren; Robert B. Chickering; Glen R. Grunewald

[57] ABSTRACT

An oil composition for use on bowling lanes is disclosed in which an organic cationic compound such as a quaternary ammonium compound or a pseudo cationic compound is distributed substantially homogenously throughout an oil component. The resulting composition exhibits a high resistance to carry-down when bowling balls are repeatedly rolled over the oiled portion of the lane.

7 Claims, No Drawings

BOWLING LANE OIL COMPOSITION

BACKGROUND OF THE INVENTION

1. Field of Invention

The invention relates to oil compounds for use on bowling lanes and the like.

2. Description of Prior Art

Bowling is a popular game in which the participants roll a ball down a lane or alley with the object of knocking down as many as possible of the ten pins which are arranged at the far end. Oil compositions of various types are applied to the bowling lane in order to provide lubrication to the ball during its travel over the first portion of the lane. These oils are typically applied over the entire width of the lane from the beginning of the lane to about 40 feet toward the pins according to individual customs and preferences. Professional bowling associations usually require that the oil be present across the entire width of any portion of the lane to which it is applied. Bowlers purposely apply certain spins to the ball so that it will curve as it travels toward the pins. The oil which is applied to the first portion of the lane allows the ball to spin relatively unimpeded until it reaches the unoiled portion of the lane at which time friction between the ball and the lane increases. In order to provide predictable and reproducible conditions on a bowling lane, it is essential that the oil be uniformly applied and that it not be carried or smeared down the lane as balls are repeatedly rolled over it. Downlane migration of oil is a significant problem in that lane conditions will change rapidly as balls are repeatedly rolled and ball performance for a given delivery will change accordingly.

One solution to downlane migration is frequent cleaning and reoiling of the bowling lanes. This is only a partial solution however since the downlane migration during a single game can cause undesirable changes in the lane conditions. It is difficult to clean and re-oil the lanes as often as would be necessary to provide reasonably uniform and stable oil distribution patterns during tournament play. Another solution involves the use of a high viscosity heavy oil which is diluted with a solvent such as kerosene so that it can be applied easily to the lane surface. After application, the solvent evaporates leaving a heavy oil which, theoretically, will be less likely to track or smear onto the unoiled portion of the lane. In practice, this type of oil has proved less than ideal and is not a practical solution to the oil migration problem.

SUMMARY OF THE INVENTION

This invention provides an oil composition for use on bowling lanes which resists migration and downlane smearing. The oil composition of the instant invention when properly applied provides substantially uniform and stable oil distribution patterns which allow for predictable and repeatable ball performance. Accordingly, the time between lane cleanings and re-oiling can be significantly extended thus saving the bowling lane operator significant time and money.

It has been found that when an effective amount of an organic cationic compound is added to and distributed substantially homogeneously throughout an oil component that the resulting composition, when applied to a bowling alley, exhibits the aforementioned properties.

An organic cationic compound is one where the organic ion is positively charged.

It is not known exactly why the addition of an organic cationic compound produces an oil which stays where it is put, but several possible theories may explain how the desired properties are obtained. The organic cationic compound is thought to have two effects. The first effect is that it is "substantive" with the finish on the lane surface. This means that the oil composition is made chemically compatible with the bowling lane surface and clings closely to it. Bowling lane surfaces are typically varnished with urethane compounds and it is thought that the organic cationic compound helps to plate the oil onto the lane surface much in the same way that hair conditioner compounds are substantive with the hair and remain attached to it even after rinsing. The other quality of organic cationic compounds is that they prevent the build up of static electricity. This may prevent the bowling ball from generating static electricity as it spins in contact with the lane and will not, accordingly, pick up oil by electrical attraction. It is believed that the organic cationic compound makes the oil stick more to the lane than to the ball thus minimizing oil carry down problems.

There are, of course, a great number of organic cationic compounds. One which has been found to be particularly effective is a water soluble quaternary ammonium compound. A quaternary ammonium compound is one in which the hydrogens in the ammonium group are replaced by organic radicals. A quaternary ammonium compound is still ionic and the quaternary ammonium ion is the positive ion while the negative ion is a typical ammonium negative ion such as chloride. The quaternary ammonium compounds, called "quats" in the art, are available commercially under various trade names. It has been found that there is no critical amount of quaternary ammonium compound and that any amount is effective to some degree. It is possible that too much quaternary ammonium compound would destroy the lubricating ability of the oil, but amounts ranging from 0.125 percent to about 5 percent by weight are known to provide useful results.

DETAILED DESCRIPTION OF THE INVENTION

It has been found that the following oil composition exhibits the aforementioned desirable properties.

| Ingredient | Percent by Weight |
|---|---|
| Synthetic Oil | 71 |
| Kerosene | 25 |
| Barquat 4280Z | 0.5 |
| CO430 | 0.5 |
| Isopropyl alcohol | 1.5 |
| Methyl lardate | 1.5 |

The synthetic oil referred to above is a polybutene based synthetic oil sold under the trade name Indopol L14 from Amoco. Barquat 4280Z is a commercially manufactured quaternary ammonium compound on which the label reads "Alkyl Dimethyl Benzyl Ammonium Chloride and Alkyl Dimethyl Ethyl Benzyl Ammonium Chloride". CO430 is the trademark for an oil soluble detergent which is used to couple the quat into the synthetic oil. The isopropyl alcohol also helps to keep the various components of the oil composition in a substantially homogeneous distribution. The methyl lardate (a methyl ester of lard) appears to improve the compatibility of the various components of the oil composition to produce uniform wetting of the oil.

Kerosene is used as a viscosity adjusting compound and is used to reduce the viscosity of the oil to one suitable for initial application to the lane surface. The kerosene will, in time, evaporate thus restoring the oil to the viscosity most suitable for its use during bowling play. Bowling lane oils are typically applied with a mop type device or with automatic lane oiling machines which use rollers.

The essential components of the invention appear to be an oil and an organic cationic compound distributed substantially homogeneously throughout the oil. A viscosity adjusting compound such as kerosene can be added to facilitate the initial application of the oil composition to the bowling lane as mentioned. Furthermore, an oil soluble detergent, preferably of the non ionic type, can be added to facilitate the solubility of the quat and other components with respect to the oil. Coupler compounds such as isopropyl alcohol and oil soluble non-ionic detergents have been found effective in holding the quat in a stable solution with the oil. Various types of oil such as petroleum based, mineral based and synthetic may be used. It has been found that synthetic oil provides good results. Methyl lardate is used to facilitate the uniform wetting and spreading of the oil on the bowling lane surface.

It is understood, for purposes of the patent application that the term organic cationic compound includes organic psuedo cationic compounds. Examples of commercially available organic psuedo cationic compounds include Polyquart H sold by the Henkel Co. for use in hair and skin applications. Polyquart H is described in the Henkel literature as PEG-15 Tallow Polyamine.

What is claimed is:

1. An oil composition for use on bowling alleys consisting essentially of:

a major amount of an oil component, from 0.125 to 5 percent by wt quaternary ammonium compound, a leveling agent in an amount sufficient to facilitate leveling of the oil over the bowling alley, and a coupler in an amount sufficient to cause the components of said composition to go into solution with one another.

2. The composition of claim 1 further comprising:

a viscosity adjusting compound.

3. The composition of claim 2 wherein said viscosity adjusting compound is kerosene in an amount sufficient to adjust the oil viscosity to a value which facilitates the initial application of said composition to the bowling lane.

4. The composition of claim 1 wherein said coupler compound is a non-ionic oil soluble detergent.

5. The composition of claim 1 wherein said coupler is isopropyl alcohol.

6. The composition of claim 4 wherein said oil is a polybutene type synthetic oil.

7. The composition of claim 4 further comprising an amount of methyl lardate sufficient to make the composition spread evenly upon application to a lane surface.

* * * * *